US008793824B2

(12) United States Patent
Poulos et al.

(10) Patent No.: US 8,793,824 B2
(45) Date of Patent: Aug. 5, 2014

(54) TILT BED

(75) Inventors: Craig Poulos, Wilmette, IL (US); Joseph Immordino, Hoffman Estates, IL (US)

(73) Assignee: Kreg Medical, Inc., Chicago, IL (US)

( * ) Notice: Subject to any disclaimer, the term of this patent is extended or adjusted under 35 U.S.C. 154(b) by 30 days.

(21) Appl. No.: 13/050,637

(22) Filed: Mar. 17, 2011

(65) Prior Publication Data

US 2012/0066832 A1 Mar. 22, 2012

Related U.S. Application Data

(60) Provisional application No. 61/340,423, filed on Mar. 17, 2010.

(51) Int. Cl.
*A61G 7/005* (2006.01)

(52) U.S. Cl.
USPC ..... 5/610; 5/600; 5/613; 5/614; 5/615; 5/616; 5/617; 5/618

(58) Field of Classification Search
CPC ..... A61G 13/04
USPC ..... 5/600, 610, 613–618
See application file for complete search history.

(56) References Cited

U.S. PATENT DOCUMENTS 3,997,926 A * 12/1976 England ..... 5/610
4,679,569 A * 7/1987 Lee ..... 600/527
5,366,036 A 11/1994 Perry
5,454,126 A 10/1995 Foster et al.
5,479,666 A 1/1996 Foster et al.
5,513,406 A 5/1996 Foster et al.
5,577,279 A 11/1996 Foster et al.
5,666,681 A 9/1997 Meyer et al.
5,715,548 A 2/1998 Weismiller et al.
6,058,533 A * 5/2000 Nelson ..... 5/610
6,151,739 A 11/2000 Meyer et al.
6,212,714 B1 4/2001 Allen et al.
6,496,993 B2 12/2002 Allen et al.
6,611,979 B2 * 9/2003 Welling et al. ..... 5/624
6,684,427 B2 2/2004 Allen et al.
6,862,762 B1 * 3/2005 Johnson et al. ..... 5/601
7,000,272 B2 2/2006 Allen et al.
7,086,107 B2 8/2006 Ellis et al.
7,171,708 B2 * 2/2007 Osborne et al. ..... 5/618
7,213,279 B2 5/2007 Weismiller et al.
7,216,389 B2 5/2007 Ellis et al.
7,523,515 B2 * 4/2009 Allen et al. ..... 5/738
8,104,123 B2 1/2012 Paz et al.
RE43,155 E 2/2012 Allen et al.
8,117,695 B2 2/2012 Paz et al.
8,566,984 B2 10/2013 Paz et al.

(Continued)

*Primary Examiner* — William Kelleher
(74) *Attorney, Agent, or Firm* — McDermott Will & Emery LLP

(57) ABSTRACT

A tilt bed for assisting a patient to a standing position comprises a frame, a tilting mechanism, a mattress support plate, a mattress, and a foot support. The tilting mechanism attaches to the frame. The tilting mechanism is movable between a generally horizontal position, and a generally vertical position. The foot support is fixedly mounted to the tilting mechanism. The main portion of the mattress and the patient thereon moves closer to the foot support during tilting of the bed from the generally horizontal position to the generally vertical position, and the main portion of the mattress and the patient thereon moves distal the foot support during tilting of the bed from the generally vertical position to the generally horizontal position in a low shear manner.

13 Claims, 3 Drawing Sheets

(56) References Cited

U.S. PATENT DOCUMENTS

| | | | | |
|---|---|---|---|---|
| 2003/0145383 | A1* | 8/2003 | Schwaegerle | 5/610 |
| 2006/0168729 | A1* | 8/2006 | Weismiller et al. | 5/618 |
| 2008/0201851 | A1* | 8/2008 | Menkedick et al. | 5/611 |
| 2009/0300845 | A1* | 12/2009 | Paz et al. | 5/610 |
| 2012/0073052 | A1* | 3/2012 | Meyer | 5/615 |
| 2012/0096644 | A1* | 4/2012 | Heimbrock | 5/600 |

* cited by examiner

TILT BED

CROSS-REFERENCE TO RELATED APPLICATIONS

This application is a continuation of U.S. Provisional Patent Application No. 61/340,423, filed on Mar. 17, 2010, which is expressly incorporated herein by reference and made a part hereof.

FEDERALLY SPONSORED RESEARCH OR DEVELOPMENT

Not Applicable.

TECHNICAL FIELD

The present invention relates generally to a bed, and more specifically to a bed being positionable to assist a patient to a standing position when the patient is lying on the bed, or to position a patient in any angular position between 0° (i.e., horizontal, lying position) and 90° (i.e., vertical, standing position).

BACKGROUND OF THE INVENTION

Hospital beds are well known in the art. Certain beds have been adapted to assist a patient to a vertical or standing position from a horizontal position when the patient is lying on the bed. This may be particularly useful for patients who have had surgery that makes movement more difficult, such as knee surgery, or for patients who have other health conditions that may make getting out of bed difficult, such as a severely obese person. Existing beds that assist a patient to a standing position often require the patient to be moved so that their feet contact a support surface of the bed that the patient will be standing on when the bed lifts them into a standing position. However, as many of these patients have limited mobility, this may be difficult to accomplish. Additionally, patients who do not leave bed very often may develop sores form being moved on the bed in order to position the patient's feet in contact with the support surface. Further, patients often need to be repositioned in bed from the foot of the bed toward the head of the bed, and moving the patients is extremely difficult and physically demanding on care givers. Therefore, a need exists for a bed that positionable to assist a patient to a standing position that does not require the patient to be moved relative to a mattress on the bed, and for a bed having a positionable mattress to assist the care giver in relocating the patient lengthwise on the bed. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings

SUMMARY OF THE INVENTION

The present invention generally provides a bed positionable to assist a patient to a standing position without repositioning the patient on a mattress of the bed.

According to one embodiment, a bed for assisting a patient to a standing position comprises a frame, a tilting mechanism, a mattress mounting plate, a mattress, and a foot support. The tilting mechanism attaches to the frame. The tilting mechanism is movable between a generally horizontal position, and a generally vertical position.

According to another embodiment, the mattress is attached to a mattress mounting plate. In one embodiment the mattress has a first air chamber, and in another embodiment the mattress also has a second air chamber. The first air chamber deflates as the tilting mechanism moves to the generally vertical position. In another embodiment the second air chamber inflates as the tilting mechanism moves to the generally vertical position. The foot support is fixedly mounted to the bed. The mattress mounting plate, and thus the mattress as well in one embodiment, moves closer to the foot support as the first air chamber deflates.

According to another embodiment, a bed for assisting a patient to a standing position comprises a frame; a tilting mechanism attached to the frame, the tilting mechanism being angularly movable between a generally horizontal position and a generally vertical position; a mattress slidingly attached to the tilting mechanism, the mattress having a first air chamber and a second air chamber, the first air chamber deflating as the tilting mechanism transitions to the generally vertical position, the second air chamber inflating as the tilting mechanism transitions to the generally vertical position; and, a foot support fixedly mounted to the tilting mechanism, wherein the mattress transitions closer to the foot support as the first air chamber deflates.

According to another embodiment, the bed further comprising a mattress support plate connected to the tilting mechanism. The mattress is slidingly attached to the mattress support plate. The mattress support plate moves closer to the foot support as the first air chamber deflates.

According to another embodiment, the first air chamber of the mattress is in fluid communication with the second air chamber.

According to another embodiment, the bed further comprises a pump connected to the first and second air chambers to independently fill the first and second air chambers.

According to another embodiment, the bed further comprises a plurality of first air chambers located adjacent a foot end of the mattress. Similarly, in another embodiment the bed further comprises a plurality of second air chambers located adjacent a head end of the mattress.

According to another embodiment, a bed for assisting a patient to a standing position comprises a frame; a tilting mechanism attached to the frame; a mattress support plate operably connected to the tilting mechanism, the tilting mechanism being movable between a generally horizontal position and a generally vertical position; and, a mattress attached to the mattress support plate, the mattress adapted to slide toward a foot end of the bed during movement of the tilting mechanism toward the generally vertical position, the mattress having a first air chamber, the air chamber deflating as the tilting mechanism moves to the generally vertical position.

According to another embodiment, the bed further comprises a foot support fixedly mounted to the tilting mechanism, and the mattress support plate moves closer to the foot support as the first air chamber deflates.

According to another embodiment, the first air chamber of the mattress is fluidly connected to the second air chamber. Air flows from the first air chamber to the second air chamber during tilting of the bed toward the generally vertical position, and air flows from the second air chamber to the first air chamber during tilting of the bed toward the generally horizontal position.

According to another embodiment, the second air chamber is substantially deflated when the bed is in the generally horizontal position.

According to another embodiment, a tilt bed for assisting a patient to a standing position comprises a frame; a tilting mechanism attached to the frame, the tilting mechanism being angularly movable between a generally horizontal position and a generally vertical position; and, a mattress slidingly attached to the tilting mechanism to allow the mattress to slide toward a foot end of the bed, the mattress having a first extender that retracts a foot section of the mattress as the tilting mechanism moves to the generally vertical position, and that expands a foot section of the mattress as the tilting mechanism moves toward the generally horizontal position.

According to another embodiment, the extender is operated by an actuator.

According to another embodiment, the bed further comprises a second extender positioned adjacent a head end of the bed, the second extender operating in reverse to the first extender section.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
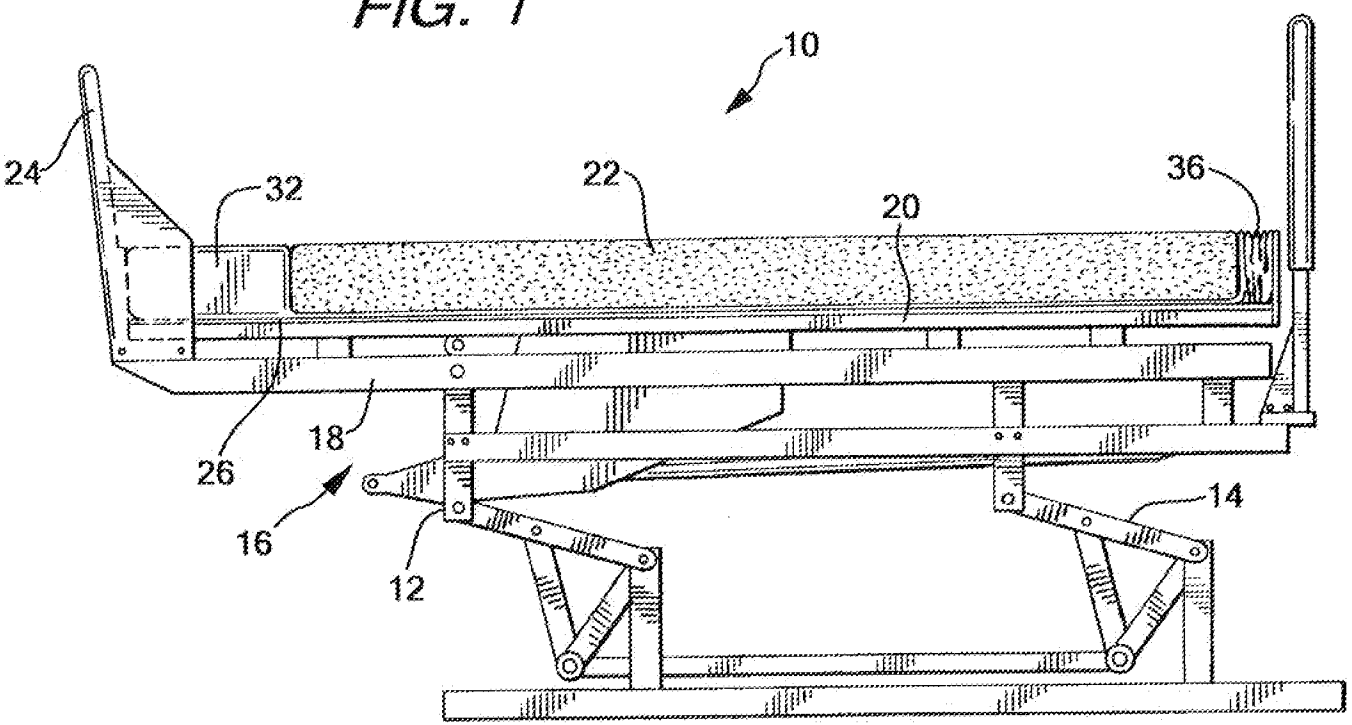
FIG. 1 is a front view of one embodiment of a tilt bed with a mattress in a generally horizontal position according to one embodiment.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the Figures, there is shown an embodiment of a tilt bed 10. The term "bed" herein is used to denote any embodiment of a support for a patient. As such, in different embodiments the "bed" is provided as a standing assist or tilt bed 10 as shown for example in FIG. 1. The tilt bed 10 may also be a chair bed (not shown), a stretcher or gurney (not shown), a surgical table (not shown), or other patient supports, etc.

In one embodiment the tilt bed 10 comprises a main frame 12 that has a lifting mechanism 14 and a tilting mechanism 16 attached thereto. The tilt bed 10 preferably also comprises a mattress 22 positioned on a mattress support plate 26, and a foot support 24. The mattress 22 may be comprised of multiple sections which may or may not be connected to one another or to the mattress support plate 26.

Figure 2:
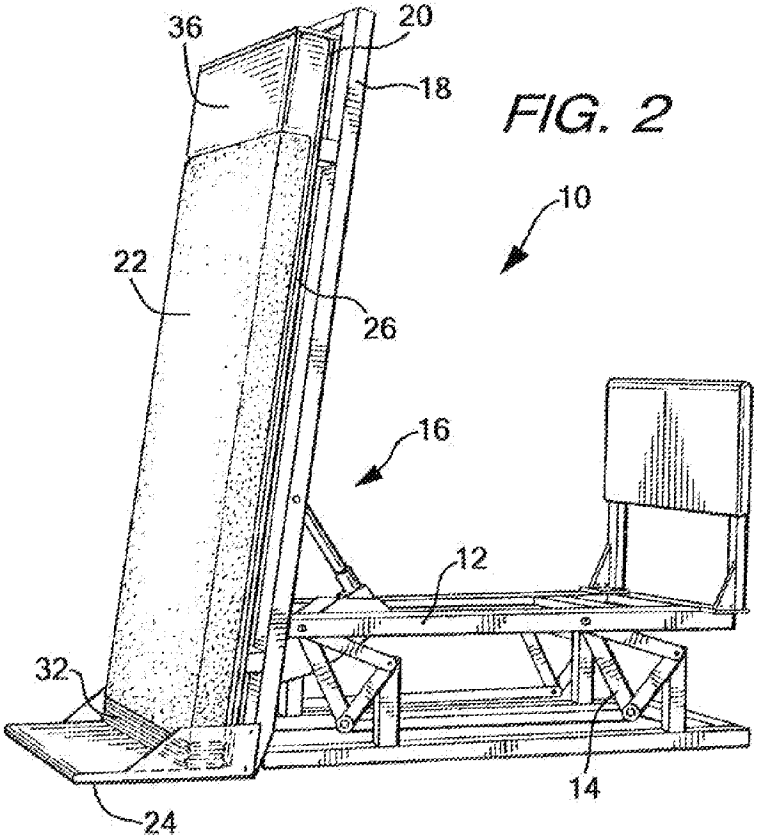
FIG. 2 is a perspective view of the tilt bed of FIG. 10 with the mattress in a generally vertical position.

The tilting mechanism 16 of the tilt bed 10 attaches to the frame 12 via the lifting mechanism 14. The lifting mechanism 14 allows the height between the mattress 22 and the floor to be altered. The tilting mechanism 16 allows the tilt bed 10 to be positioned from a generally horizontal position as shown in FIG. 1, to a generally vertical position as shown in FIG. 2. In one embodiment the foot support 24 connects to the frame 18 of the tilting mechanism 16. The foot support 24 is adapted to support a patient's feet as the tilting mechanism 16 is moved from the generally horizontal position to the generally vertical position, thus supporting a patient when positioning the patient in various angular positions between 0° and 90°, including when positioning the patient from the generally horizontal position to a standing position with the patient's feet on the foot support 24, as well as from the generally vertical position back to the generally horizontal position.

Figure 3:
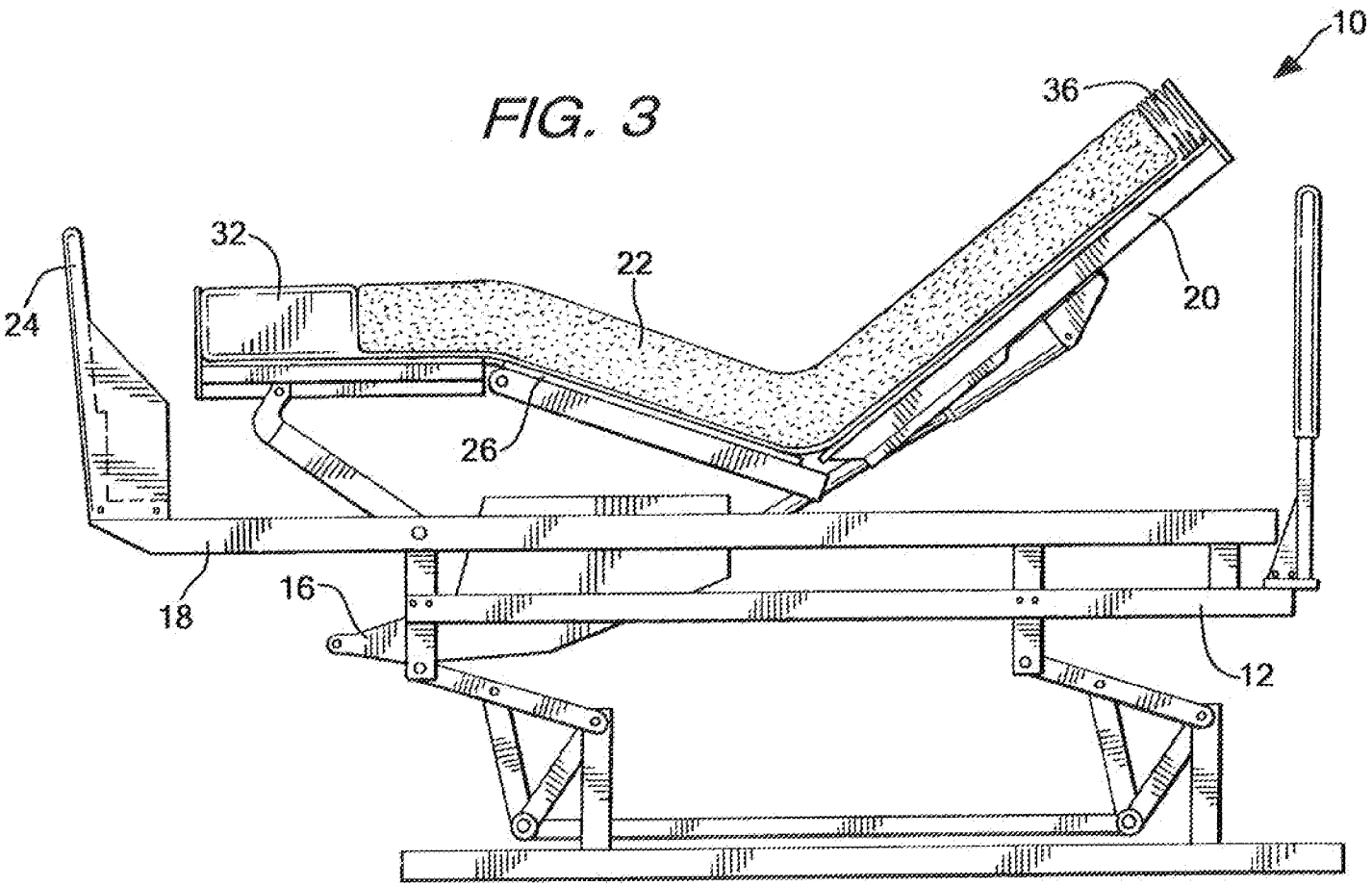
FIG. 3 is a side view of the tilt bed of FIG. 10 with the head section and foot section of the mattress in a raised position.

In one embodiment, the mattress support plate 26 attaches to the patient support frame 20. The mattress support plate 26 supports each section of the mattress 22, and, as explained herein, allows the mattress 22 to traverse longitudinally thereon between the head and foot ends of the bed 10. In one embodiment as shown in FIGS. 1-3, the mattress 22 has at least a first air chamber 32 disposed at a first or foot end of the mattress 22 nearest the foot support 24. It is contemplated that an air flow valve (not shown) is disposed in fluid communication with the first air chamber 32 to control the flow of air into and out of the first air chamber 32. Optionally, in another embodiment a second air chamber 36 may be disposed at a second or head end of the mattress 22, distal the foot support 24. It is understood that additional air chambers may be provided at the head end, foot end or both the head end and foot ends of the mattress 22 (not shown in the figures). For example, a plurality of individual first air chambers 32 may be provided at the foot end of the mattress 22. Similarly, a plurality of individual second air chambers 36 may be provided at the head end of the mattress 22. It is further contemplated that the plurality of first air chambers 32 may extend toward and up to a mid-line of the mattress 22, and that the plurality of second air chambers 36 may extend toward and up to the mid-line of the mattress 22. Each of such first air chambers 32 and second air chambers 36 may be independently inflatable and deflatable, as is explained herein in reference to the embodiment having a single first air chamber 32 and/or a single second air chamber 36.

The first air chamber 32 and the second air chamber 36 may be connected by an air line (not shown) to allow air to be transferred between the first air chamber 32 and the second air chamber 36. The first air chamber 32 is adapted to allow air to flow out of the first air chamber 32 to allow the movable mattress support 26 to move towards the foot support 24 as the tilting mechanism 16 moves towards the generally vertical position. Similarly, in such an embodiment where there are a plurality of first air chambers 32 and a plurality of second air chambers 36, the end most first air chamber 32 will be in fluid communication with the end most second air chamber 36 to allow air to flow between those chambers as explained above, the second end most first air chamber 32 will be in fluid communication with the second end most second air chamber 36 to allow air to flow between those chambers as explained above, and so on for each of the plurality of first air chambers 32 and second air chambers 36. In one embodiment, air is preferably evacuated from the first air chamber 32 while the tilting mechanism 16 is moving towards the generally vertical position until the patient's feet contact the foot support 24. Alternately, the foot support 24 will have a sensor (not shown) that detects the pressure of the mattress 22 on the foot board 24 as the bed tilts. The sensor will trigger the release of the air from the chamber 32 to evacuate the first air chamber 32. The middle or central portion 38 of the mattress 22 may be made of foam, air cells, gel, or any other appropriate structure and composition.

In an alternate embodiment, however, air (or whatever fluid is in the chambers) may be moved between the appropriate first air chamber 32 and the corresponding second air chamber 36 in non-tilt situations. For example, throughout the day patients often slide toward the foot end of the bed 22. Such situation occurs as a matter of course, including as the head of the bed 10 is lifted for the patient. Accordingly, care providers are often required to move the patient back toward the head end of the bed. Such moving of the patients back toward the head end of the bed is physically cumbersome for the care giver and is uncomfortable and often dangerous for the patient. When multiple first and second air chambers 32, 36 are incorporated into a mattress 22, the mattress 22 may be manipulated such that a plurality of second air chambers 36 at the head end of the bed may be sequentially deflated and a corresponding plurality of first air chambers 32 at the foot end of the bed may be sequentially inflated to effect a movement of the mattress 22 with the patient thereon toward the head end of the bed 10. It is also understood that extra air mattress sections (not shown) may be provided at the head end and foot end of the mattress 22 to allow for such movement. For example, in the example just provided, one of the extra first air mattress sections 32 at the foot end of the bed may be inflated as the second air chamber 36 at the head end of the bed is deflated to essentially allow the overall mattress 22 to transition a longitudinal distance equal to the inflated chamber toward the head end of the bed 10. In one such an embodiment the mattress 22 may slide longitudinally on the mattress support plate 26.

As shown in FIGS. 1-3, and as explained above, in multiple embodiments the mattress 22 also has a second air chamber 36 in addition to the first air chamber 32. The first and second air chambers 32, 36 may be independent or they may be in fluid communication. In the embodiment where the first air chambers 32 are in fluid communication with the second air chambers 36, when the air flow valve is opened and as the tilting mechanism 16 is moved to the generally vertical position air is evacuated out of the first air chamber 32 and is directed, typically via tubing, to the second air chamber 36. The second air chamber 36 may have a second air flow valve (not shown) to control the flow of air into and out of the second air chamber 36. However, it is also contemplated that the air flow valve of the first air chamber 32 may be a two-way valve that controls the flow of air between the first air chamber 32 and the second air chamber 36. An air pump (not shown) may also be provided that is in fluid communication with each of the first air chambers 32 and/or each of the second air chambers 36. The air pump may provide air to any of the air chambers at any time as required, including to the second air chamber 36 as the tilting mechanism 16 moves towards the generally vertical position. Similarly, the air pump may provide air to the first air chamber 32 as the tilting mechanism moves from the generally vertical position towards the generally horizontal position. The deflation of the first air chamber 32 allows the mattress 22 to slide toward the foot support 24, thereby bringing the patient's feet into contact with the foot support 24 as the tilting mechanism 16 moves towards the generally vertical position. In one embodiment the deflation of the first air chamber 32 and the subsequent inflation of the second air chamber 36 keep the overall dimensions of the mattress 22 relatively constant, preventing a large gap from forming between the mattress 22 and either the head end or the foot end of the bed 10.

If the mattress 22 only has the first air chamber 32 the air flow valve may release the air from the first air chamber 32 into the atmosphere. In an embodiment where the air flow valve vents air from the first air chamber 32 into the atmosphere, an air pump (not shown) is preferably provided in order to refill the volume of air in the first air chamber 32 when the tilting mechanism 16 moves towards the generally horizontal position. In this manner the patient will be transitioned on the mattress 22 away from the foot support 24. It is also contemplated that an accumulator, such as an air tank, may be provided to collect air released from the first air chamber 32 as the tilting mechanism 16 moves towards the generally vertical position, and the accumulator may also provide air back into the first air chamber 32 as the tilting mechanism moves towards the generally horizontal position. Similarly, an accumulator may be utilized with the second air chamber 36.

Figure 5:
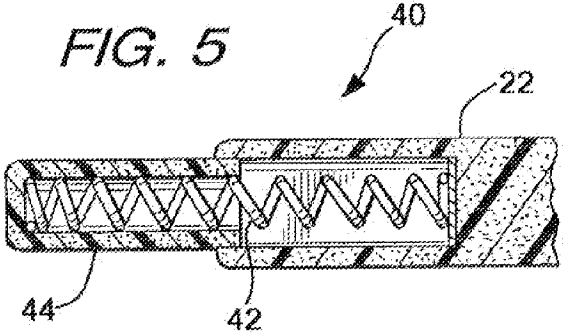

In an alternate embodiment shown in FIG. 5 the mattress 22 has a mechanical mechanism 40 at the foot end of the mattress 22. In one embodiment the mechanical mechanism 40 comprises a mechanical retraction mechanism 42, such as a spring or actuator that can operate to retract and extend a foot section 44 of the mattress 22. Accordingly, in this embodiment the mechanical mechanism 40 generally replaces the first air chamber 32. In use, as the tilting mechanism 16 moves the mattress 22 from the generally horizontal position to the generally vertical position the mechanical mechanism 40 operates to allow or cause the foot section 44 of the mattress to retract toward or into the main portion of the mattress 22. Similarly, as the tilting mechanism 16 causes the mattress 22 to move from the generally vertical position to the generally horizontal position the retraction mechanism 42 operates to extend the foot section 44 of the mattress 22 to its extended position.

Figure 4:
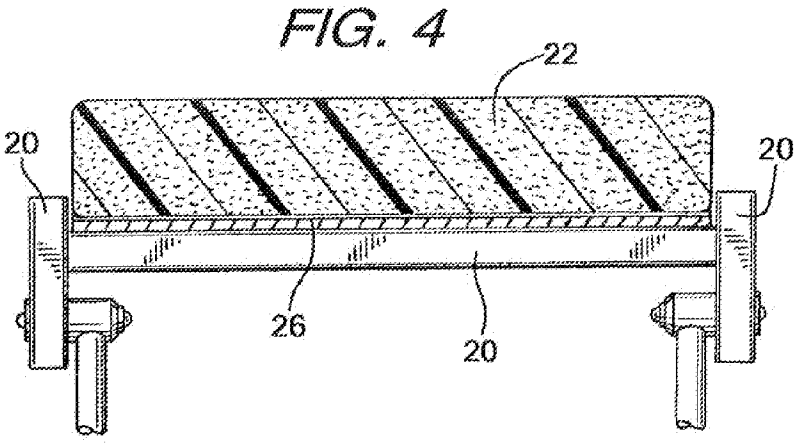
FIG. 4 is a partial cross-sectional end view of the mattress and the moveable mattress support plate; and, FIG. 5 is a partial cross-sectional side view of another embodiment of a mattress with an extension section.

As explained herein, the bed 10 also comprises a mattress support plate 26, as shown in FIG. 4, which allows the mattress 22 to traverse longitudinally with respect to the bed 10. The mattress support plate 26 may be connected to the patient support frame 20. In one embodiment the mattress support plate 26 has a low friction surface that allows the mattress 22 to slide on the mattress support plate 26. Preferably the low friction surface has a coefficient of friction of approximately at least 0.5, preferably at least 0.1, and most preferably at least 0.06. The low friction surface may be provided by a coating on the mattress support plate 26, or it may be provided by a material on or of the mattress support plate 26. For example, the mattress support plate 26 may have a Teflon or UHMW surface. Alternately, other materials and coatings may be provided on the mattress support plate 26 to allow for sliding of the mattress 22 between the generally horizontal and generally vertical positions of the bed 10. Alternately, the surface of the mattress support plate 26 may have rollers or some other mechanical mechanism (not shown) that allow the mattress 22 to traverse longitudinally on the mattress support plate 26. Similarly, in an alternate embodiment the mattress 22 may also have a low friction surface that contacts the low friction surface of the mattress support plate 26. By utilizing a sliding mattress 22, the patient and the mattress 22 move together when the bed 10 is transitioned from the generally horizontal position to the generally vertical position, and when the mattress 22 is transitioned longitudinally on the mattress support plate 26 even if the bed is maintained in the horizontal position. Thus, there is very low or no shear existing between the patient and the mattress 22 in this embodiment during tilting of the bed 10 when the patient and mattress 22 slide toward and away from the foot support 24 and/or during movement of the mattress 22 longitudinally on the mattress support plate 26.

In another alternate embodiment the mattress support plate 26 is connected to the mattress 22 and slides in a track provided by the patient support frame 20 of the tilting mechanism 16.

In yet another alternate embodiment, the mattress support plate 26 has plurality of rollers, wheels or sliding members (not shown) that attach the mattress support plate 26 to the tilting mechanism 16, preferably through the patient support frame 20. The rollers may be fixedly attached to the mattress support plate 26, however, the rollers may rotate, allowing the mattress support plate 26 to move within a track or between the opposing patient support frame members 20 of the tilting mechanism 16, in order to constrain the motion of the mattress support plate 26 to longitudinal motion along a single axis. Alternately, the patient support frame 20 may operate as a sidewall, as shown in FIG. 4, to constrain the motion of the mattress 22 and/or the mattress support plate 26 to longitudinal motion along a single axis.

In yet another alternate embodiment the mattress support plate 26 may be fixed, and the mattress 22 may slide or traverse on the mattress support plate 26. This may be accomplished with or without mechanical sliding components. For example, the surface of the mattress support plate 26 may have a Teflon or other sliding surface that allows the mattress 22 to slide freely thereon. Alternately, the surface of the mattress support plate 26 may have rollers or some other mechanical mechanism (not shown) that allow the mattress 22 to traverse longitudinally on the mattress support plate 26.

Thus, the present disclosure provides a bed 10 that is capable of utilizing a tilting mechanism 16 to position a patient to a standing position. The present disclosure also provides a mattress 22 that is capable of transitioning longitudinally on the mattress support plate 26, both toward the head end of the bed and toward the foot end of the bed as desired. The bed 10 also provides for moving the patient longitudinally toward and away from the foot support 24 without having to move the patient relative to the mattress 22 of the bed 10. To accomplish this low shear feature, in one embodiment a first air chamber 32, or a plurality of first air chambers 32, is deflated as the tilting mechanism 16 is positioned to a generally vertical position, thus bringing the patient's feet into contact with the foot support 24, such that the patient is standing on the foot support 24 at the end of the rotation of the tilting mechanism 16.

In an alternate embodiment an extender or mechanical mechanism 40 can operate to retract and extend a foot section 44 and/or a head section of the mattress 22. Accordingly, in this embodiment the mechanical mechanism 40 generally replaces the first air chamber 32. The mechanical mechanism may be a spring, an actuator, or any other mechanical component that can extend and retract as necessary. In use, as the tilting mechanism 16 moves the mattress 22 from the generally horizontal position to the generally vertical position the mechanical mechanism 40 operates to allow or cause the foot section 44 of the mattress to retract toward or into the main portion of the mattress 22, thereby allowing the patient to be moved toward the foot support 24 when titling from the generally horizontal position to the generally vertical position. An extending mechanism may also extend from a head end of the mattress and may extend as the mechanical mechanism at the foot end retracts to maintain a constant mattress length. Similarly, when the patient wishes to lay down, the patient steps onto the foot support, the tilting mechanism 16 moves to a generally horizontal position, and the first air chamber is inflated, or the mechanical mechanism 40 at the foot end is extended, as the tilting mechanism 16 is moving, positioning the patient distal the foot support 24 in a very low or no shear translation. Simultaneously, the expanded section at the head end of the mattress, whether it is an air bladder(s) 36 or a mechanical section, is retracted to maintain the overall mattress length constant. In this manner, a patient with limited mobility is provided the opportunity to safely exit the bed 10, and the patient is not moved relative to the mattress 22 during the process, reducing the risk of sores forming on the patient, and allowing fewer healthcare workers to be required to place a patient into a standing position.

Additionally, it is understood that the tilting mechanism 16 may be stopped at any desired angle between the generally horizontal position and the generally vertical position to allow for various therapeutic loads to be applied to the load supporting portions of the patient's body.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

We claim:

1. A bed for assisting a patient to a standing position comprising:

a frame;

a tilting mechanism attached to the frame, the tilting mechanism being angularly movable between a generally horizontal position and a generally vertical position;

a mattress slidingly attached to the tilting mechanism, the mattress having a first air chamber and a second air chamber, the first air chamber deflating as the tilting mechanism transitions to the generally vertical position, the second air chamber inflating as the tilting mechanism transitions to the generally vertical position, wherein the first air chamber is in fluid communication with the second air chamber; and, a foot support fixedly mounted to the tilting mechanism, wherein the mattress transitions closer to the foot support as the first air chamber deflates.

2. The bed of claim 1, further comprising a mattress support plate connected to the tilting mechanism.

3. The bed of claim 2, wherein the mattress is slidingly attached to the mattress support plate.

4. The bed of claim 1, further comprising a pump connected to the first and second air chambers to independently fill the first and second air chambers.

5. The bed of claim 2, wherein the mattress support plate moves closer to the foot support as the first air chamber deflates.

6. The bed of claim 1, further comprising a plurality of first air chambers located adjacent a foot end of the mattress.

7. The bed of claim 6, further comprising a plurality of second air chambers located adjacent a head end of the mattress.

8. A bed for assisting a patient to a standing position comprising:

a frame;

a tilting mechanism attached to the frame;

a mattress support plate operably connected to the tilting mechanism, the tilting mechanism being movable between a generally horizontal position and a generally vertical position; and, a mattress attached to the mattress support plate, the mattress adapted to slide toward a foot end of the bed during movement of the tilting mechanism toward the generally vertical position, the mattress having a first air chamber, the air chamber deflating as the tilting mechanism moves to the generally vertical position, the mattress having a second air chamber, wherein the first air chamber is fluidly connected to the second air chamber, wherein air flows from the first air chamber to the second air chamber during tilting of the bed toward the generally vertical position, and wherein air flows from the second air chamber to the first air chamber during tilting of the bed toward the generally horizontal position.

9. The bed of claim 8, further comprising a foot support fixedly mounted to the tilting mechanism, wherein the mattress support plate moves closer to the foot support as the first air chamber deflates.

10. The bed of claim 8, wherein the mattress support plate moves closer to the foot support as the first air chamber deflates.

11. The bed of claim 8, wherein the first air chamber is located adjacent a foot end of the mattress.

12. The bed of claim 8, wherein the second air chamber is substantially deflated when the bed is in the generally horizontal position.

13. The bed of claim 8, further comprising a pump connected to the first and second air chambers to independently fill the first and second air chambers.

* * * * *